United States Patent [19]

May

[11] 4,301,593

[45] * Nov. 24, 1981

[54] ANTI-SPIN COUPLING FOR ORBITING DISC RAZOR

[76] Inventor: Russell P. May, P.O. Box 3241, Indialantic, Fla. 32903

[ * ] Notice: The portion of the term of this patent subsequent to Jan. 1, 1997, has been disclaimed.

[21] Appl. No.: 108,052

[22] Filed: Dec. 28, 1979

[51] Int. Cl.[3] ..... B26B 19/12

[52] U.S. Cl. ..... 30/42; 30/43.3

[58] Field of Search ..... 30/42, 44, 45, 43.3, 30/50, 32

[56] References Cited

U.S. PATENT DOCUMENTS 2,077,805 4/1937 Muros ..... 30/43.3

3,027,636 4/1962 Wahnish ..... 30/45

3,921,270 11/1975 Upton ..... 30/43.3

4,180,906 1/1980 May ..... 30/42

*Primary Examiner*—Gary L. Smith

*Attorney, Agent, or Firm*—James H. Littlepage

[57] ABSTRACT

Annular discs having narrow sharp edge slots therethrough are supported in circular raceways in a razor head by eccentric drive balls which impart planetary motion thereto. The eccentric drive balls are pivotally mounted on the ends of rapidly rotating drive shafts so that they swing outwardly away from the shaft axis, thereby pressing the edges of the discs against the edges of the raceways, preventing spinning of the discs and imparting thereto a tendency to rotate slowly, contrary to the orbiting directions of the discs.

4 Claims, 11 Drawing Figures

Fig. 1
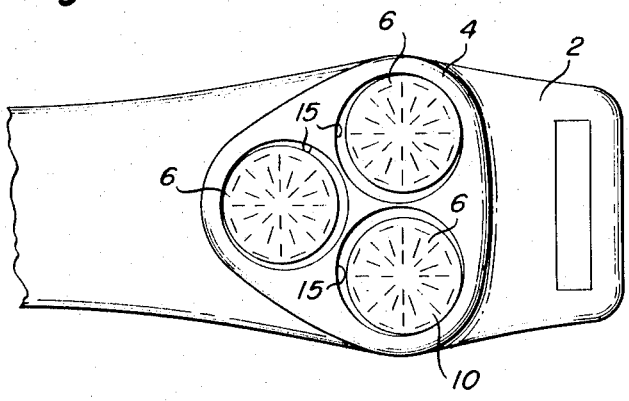
Fig. 2
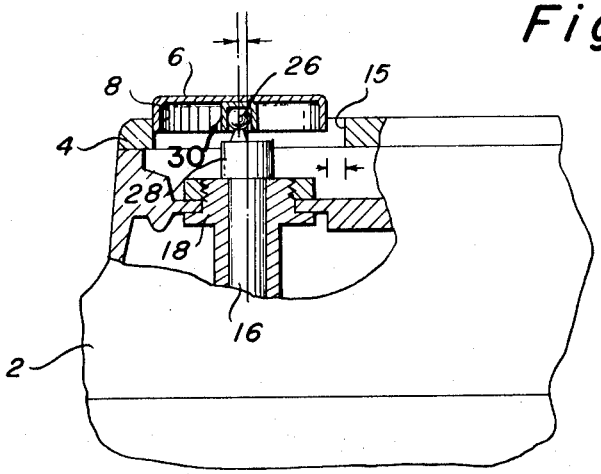
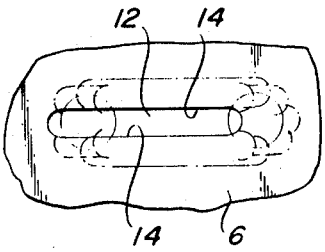
Fig. 3
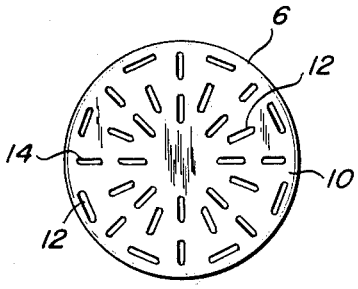
Fig. 4

ANTI-SPIN COUPLING FOR ORBITING DISC RAZOR

RELATED APPLICATION

Russell P. May RAZOR WITH ORBITING DISCS WITH SHARP EDGE SLOTS AND METHOD FOR MAKING DISCS, Ser. No. 847,413 filed Oct. 31, 1977, scheduled for issue Jan. 1, 1980 as U.S. Pat. No. 4,180,906 of which this is a continuation-in-part.

1. Field of Invention

Cutlery, Razors with blade moving means

2. Prior Art

Upton U.S. Pat. No. 3,921,270; Sahai et al. No. 3,919,770; Muros No. 2,077,805; Schaufelberger No. 2,619,719; and Avid No. 2,592,146

OBJECTS

In my previous application annular discs having sharp edge slots orbit in circular raceways so that the edges of the slots slice across hair when the discs are pressed against user's face. While frictional contact of the discs against the face constrains the discs spinning, as does the contact of the disc edges against the edges of the raceways, the object now is to asure that the discs will not spin when they are not in contact with the user's skin. In my prior application, the orbital motions were imparted to the discs by means of eccentric balls on the ends of the drive shaft, which balls are engaged in spring-sockets on the undersides of the discs. In accordance with the present improvements, it is intended now to pivotally mount the balls on the ends of the drive shaft so that the balls move under centrifugal forces to positions of eccentricity with respect to the axis of rotation of the drive shaft, so that the balls yieldably press the outer edges of the circular discs against the surrounding edges of the circular raceway in which they orbit.

These and other objects will be apparent in from the following specification and drawings, in which;

FIG. 1 is a plan view of a razor incorporating the invention;

FIG. 2 is a fragmentary cross-section of the razor showing the eccentric drive for an orbiting disc;

FIG. 3 is a fragmentary plan view showing a single sharp-edge slot and illustrating, with broken-shaft arrows, the orbital motion;

FIG. 4 is a plan view of a single disc;

Figure 5:
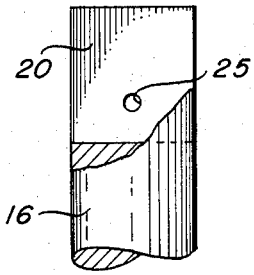
FIG. 5 is a side elevation of the upper end of a drive shaft, with the eccentric ball and associated parts removed.

Referring now to the drawings, in which like reference numerals denote similar elements, FIG. 1 shows an electric razor incorporating the invention. Although the invention is adapted to different types and kinds of razors, for purposes of illustration it shown as it could be embodied in a Norelco Electric Razor 2 having a shaving head 4. According to this invention, there are disposed in the head three discs 6 having annular side skirts 8, and flat tops 10 each having an array of slots 12 bounded by sharp edges 14. The discs orbit in circular raceways 15 in head 4, as will be described herein after. Suitable means, not shown, may be used to limit the tilting movements of the disc. The slots can be arranged in various patterns, for example, such as to extend radially and tangentially as illustrated in FIGS. 1 and 4. They are narrow, in the order of a few hundreths of an inch in width and bounded by sharp edges 14.

Figure 6:
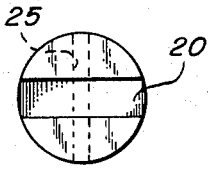
FIG. 6 is a plan view of the post shown in FIG. 6.
Figure 7:
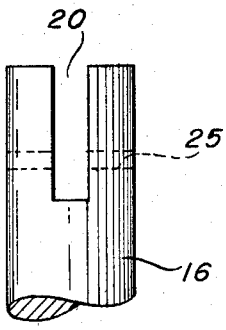
FIG. 7 is an end view of the post as shown in FIGS. 5 & 6.
Figure 8:
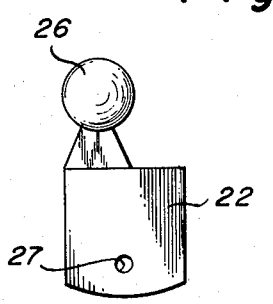
FIG. 8 is a side elevation of a flat arm and ball thereon removed from the post.
Figure 9:
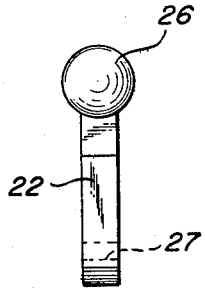
FIG. 9 is an end view of the flat arm and ball as shown in FIG. 8.
Figure 10:
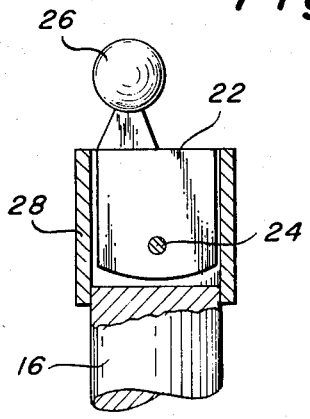
FIG. 10 is a view of the upper end of the post as shown in FIG. 5, but with the eccentric drive assembly mounted therein.
Figure 11:
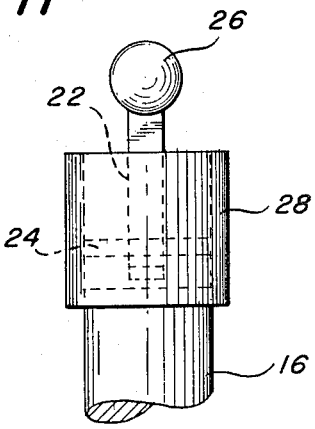
FIG. 11 is a end view of the assembly shown in FIG. 10.

FIGS. 2 and 5 through 11 show the eccentric drives for discs 6. Drive shafts 16, one of which is shown, rotatably supported in bearings 18 are driven via conventional gears from an electric or spring motor, not shown. In the upper ends of shafts 16 are slots 20 in which flat arms 22 are pivotally mounted by pintle 24 which engage through pintle holes 25 through the posts and through pintle holes 27 in arms 22. The flat opposite sides of the arms 22 slidably engage against the flat sides of slots 20. On the upper ends of each arm 22 is an eccentric ball 26 which, when shaft 16 rotates, swings outwardly away from the rotational axis of shaft 16. A cylindrical housing 28 is pressure fitted over the upper end of the post. Suitable clearance is provided so that the balls 26 can swing to outer extremities under centrifugal force. Balls 26 are grasped within spring finger sockets 30 on the undersides of disc 6.

In operation, when the razor is turned "on" and drive shaft 16 is rapidly rotated, the balls 26 swing outwardly to their eccentric extremities, as determined by the confines of housing 28, so that the discs 6 partake of the orbital motions illustrated in FIG. 3. The sharp edges 14 of slots 12 slice through the hairs which project through the slots 12 as the flat surfaces of the discs 6 engage against the user's skin. In the extreme eccentric positions of balls 26, the skirts 8 of the discs 6 engage against the edges of raceways 15 so that the discs rotate slowly in a direction opposite to the orbital direction of the discs. When the surfaces of the discs engage against the user's skin, the discs are constrained against other than the orbital motion illustrated in FIG. 3. The clearances between housing 28 and the edges of plate 22 are such as to permit the balls 26 to swing to outer extremities, but not so much as to permit the balls to swing to positions of concentricity with respect to the rotational axis of the shafts 16; in other words, the balls 26 are always eccentric with respect to the rotational axis of shafts 16 so that the discs always partake of orbital motions when shafts 16 rotate.

I claim:

1. In a razor, head surface means having an annular raceway therein, a flat annular disc disposed in said raceway, the periphery of said disc being smaller than the diameter of said raceway, and means for imparting orbital motion to said disc in the plane thereof whereby said sharp edges slice along the skin surface against which one side of said disc is engaged, said means comprising, a socket on the other side of said disc, a ball engaging in said socket, a rotating drive shaft, a means mounting said ball on said drive shaft for rotation therewith, said means providing freedom of movement of said ball under centrifugal force to an extremity of eccentricity with respect to the rotational axis of said drive shaft, whereby to force the periphery of said disc against the raceway as said disc orbits.

2. A razor as claimed in claim 1, the means mounting said ball on said drive shaft comprising an arm and pivot means mounting one end of said arm on said drive shaft, said ball being affixed on the other end of said arm.

3. A razor as claimed in claim 2, said drive shaft having a slot in the end thereof, said arm being disposed in said slot and having flat opposite surfaces slidably engaging against the sides of said slot.

4. A razor comprising, a casing having a wall, a generally flat planar disc loosely disposed in a surrounding raceway in said wall and adapted for one flat side thereof to be engaged against a skin surface to be shaved, a plurality of apertures through the disc bounded by sharp edges on opposite sides of the apertures, drive means for moving said disc about an orbit approximately equal to or slightly greater than the distance between said opposed sharp edges, said drive means comprising a socket on the other side of the disc, a rotating shaft disposed substantially normal to the plane of the disc, and an eccentric ball pivoted on said shaft and engaged in said socket.

* * * * *